United States Patent [19]

Kukla

[11] 4,153,324

[45] May 8, 1979

[54] SELF-STRIPPING ELECTRICAL TERMINAL

[75] Inventor: Frank A. Kukla, Cicero, Ill.

[73] Assignee: Microdot, Inc., Franklin Park, Ill.

[21] Appl. No.: 884,489

[22] Filed: Mar. 8, 1978

[51] Int. Cl.[2] ..... H01R 11/20

[52] U.S. Cl. ..... 339/97 R

[58] Field of Search ..... 339/97 R, 97 P, 97 L, 339/98, 99

[56] References Cited

U.S. PATENT DOCUMENTS

| | | | |
|---|---|---|---|
| 3,162,501 | 12/1964 | Wahl | 339/98 |
| 3,683,319 | 8/1972 | Vigeant et al. | 339/97 R |
| 3,760,331 | 9/1973 | Gurley | 339/97 P |
| 3,824,527 | 7/1974 | Evans | 339/97 R |
| 3,895,852 | 7/1975 | Wasserlein, Jr. | 339/99 R |
| 4,040,702 | 8/1977 | McKee | 339/97 R |
| 4,088,382 | 5/1978 | Schimura | 339/99 R |

*Primary Examiner*—Joseph H. McGlynn

*Attorney, Agent, or Firm*—Burns, Doane, Swecker & Matis

[57] ABSTRACT

An electrical terminal that has a mounting portion and an integral conductor clamping portion. The clamping portion includes a base and a pair of walls projecting from the base. Each wall includes two arm portions forming a V-shape. Each arm portion includes a guide surface and a termination surface. The guide surface has a sharpened edge for severing the insulation of a conductor. The guide surface is inclined from this edge in such fashion that the cut insulation is wedged outwardly away from the internal conductor. Contact between the termination surface and the wire portion of the conductor occurs along the entire width of such surface. Opposing walls of the terminal flex laterally outwardly, and the arm portions of each wall flex outwardly at an acute angle, during termination. As a result, the clamping action of the walls and arm portions generates forces having longitudinal and lateral directional components.

14 Claims, 10 Drawing Figures

SELF-STRIPPING ELECTRICAL TERMINAL

BACKGROUND AND OBJECTS OF THE INVENTION

The present invention relates to methods and apparatus for making electrical contact with insulated wire conductors and, more particularly concerns an electrical terminal which strips the insulation and grips the wire strands automatically as the conductor is pressed into the terminal.

Self-stripping electrical terminals are conventional, as demonstrated for example by the following U.S. Pats: No. 3,594,712 issued to Enright et al on July 1971; No. 3,683,319 issued to Vigeant et al on August 1972; No. 3,703,700 issued to Kloth et al on Dec. 10, 1974, as well as by a brochure entitled "Now Flex-Com" of Winchester Electronics, a division of Litton Industries, and by a brochure dated Feb. 1976 and entitled "Blue Macs Cable/Connector System" (No. D.S. 609.3) of T & B/Ansley Corp., a subsidiary of Thomas R. Betts Corp. Typically, such terminals include upstanding walls forming spaced slots therebetween. Inclined guide surfaces are spaced above the slots for supporting and guiding a wire to be terminated. As the wire is pushed into the slots, sharpened edges on the terminal cut through the insulation, enabling contact to be made with the wire conductor. A nose projects from the walls for connection with a circuit board or the like.

It is desirable that firm contact be established between the terminal and the conductor for a positive, long-lasting electrical connection. At the same time, however, the pressure requirements for terminating the conductor should not be unduly high. It is preferable that these criteria be met without the need for specially designed insulator housings to support and reinforce the terminal as termination is made.

Notwithstanding the many previous proposals for terminals of this nature, considerable room for improvement remains.

It is, therefore, an object of the invention to provide a novel electrical terminal for fulfilling the above-discussed needs.

It is a further object of the invention to provide a novel self-stripping terminal which easily accommodates termination of a wire and thereafter imparts a firm, long-lasting gripping action on the wire conductor.

It is another object of the invention to provide a self-stripping terminal which does not require the support of an insulative housing during termination.

It is yet another object of the invention to provide a self-stripping terminal which prevents the stripped insulation portion from interferring with the electrical contact.

BRIEF SUMMARY OF THE INVENTION

In achieving these objects, the present invention involves an electrical terminal of the type including a mounting portion and an integral conductor clamping portion which strips and captures an insulated conductor. The clamping portion includes a base and a pair of walls projecting from the base. Each wall includes a pair of arm portions, the arm portions of one wall being spaced oppositely from corresponding arm portions of the other wall to form a pair of longitudinally spaced slots. Each arm portion extends at an acute angle relative to a plane bisecting a vertex joining the arm portions. Each arm portion comprises a guide surface inclined toward its associated slot such that the opposing arm portions of each wall orient a conductor above the slots. Each guide surface includes an inner edge which is sharpened to define a cutting edge for piercing an insulation cover of the conductor as the conductor is pushed into the slots. Each guide surface is inclined from the cutting edge in a direction generally away from the other guide surface of the same wall so that as the insulation cover is pierced, it is wedged outwardly of the terminal. Each arm portion also includes a termination surface extending from the guide surface toward the base and forming the sides of the slots. Each termination surface is oriented such that conductive engagement between the termination surface and the wire portion of the conductor extends along the entire width of the termination surface.

THE DRAWING

These and other objects of the invention will become apparent from the following detailed description of a preferred embodiment thereof in connection with the accompanying drawing wherein like numerals designate like elements and in which.

DETAILED DESCRIPTION OF A PREFERRED EMBODIMENT OF THE INVENTION

Figure 1:
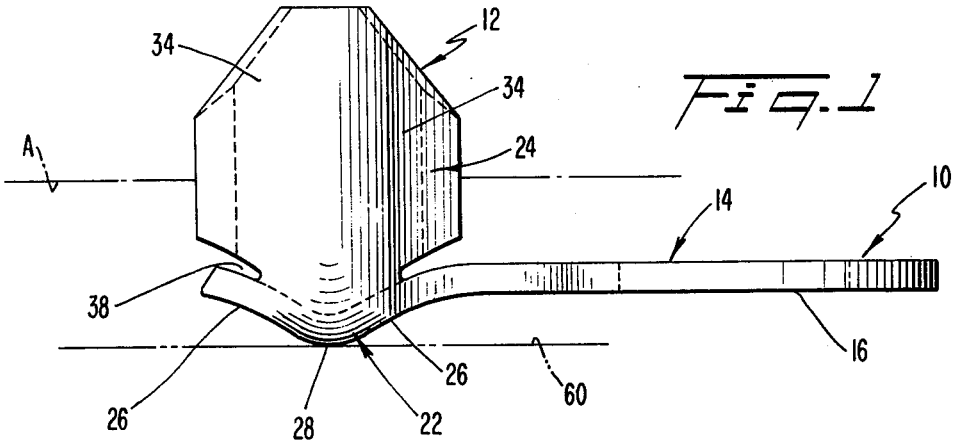
FIG. 1 is a side elevational view of a terminal according to the present invention.

The preferred contact 10 comprises a clamping portion 12 and an integral mounting portion 14 in the form of a ringshaped nose 16 extending therefrom. These clamping and mounting portions 12, 14 are formed from a single sheet of metal by a suitable bending process.

The configuration of the mounting portion 14 is not of critical importance in the context of the present invention. This mounting portion may be of configurations other than than shown such as tube or blade shape among others.

Figure 5:
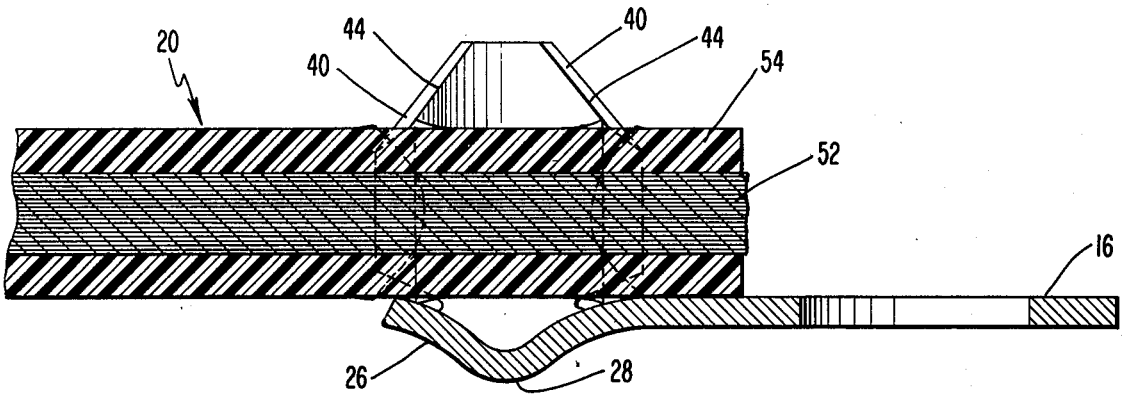
FIG. 5 is a longitudinal section through the terminal following termination of a conductor.
Figure 6:
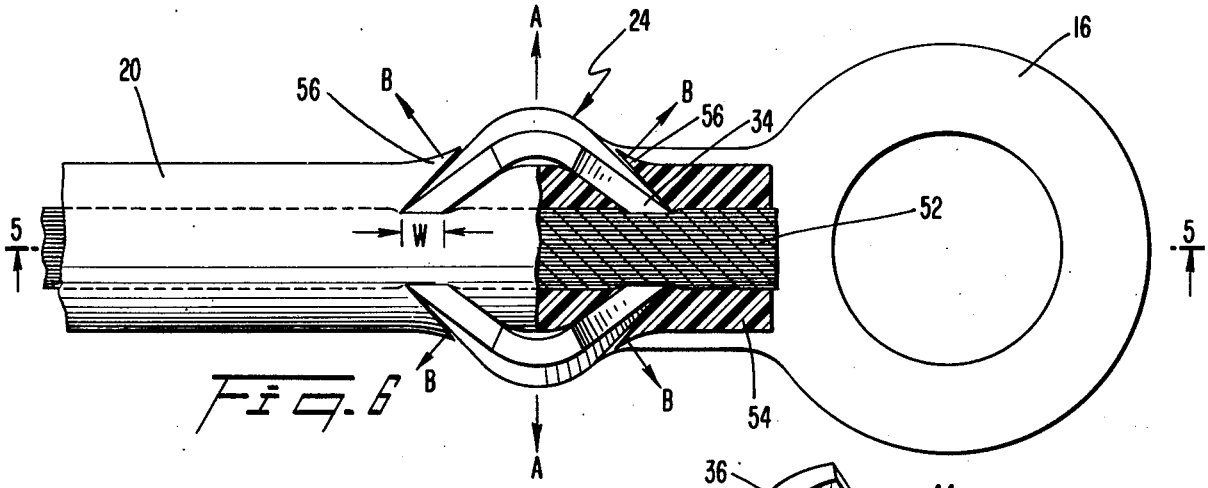
FIG. 6 is a plan view of the terminal following termination, with part of the conductor depicted in longitudinal section to demonstrate the gripping action of the terminal.

The clamping portion 12 is oriented generally laterally of the plane of the mounting portion 14 and defines a lateral socket 18 which retains a conductor 20 wherein the conductor axis lies parallel to the plane of the mounting portion (see FIGS. 5 and 6).

The clamping portion 12 comprises a base 22 and a pair of socket walls 24 extending laterally outwardly therefrom. The base is generally concave in configuration, as viewed from inside the socket. More particularly, longitudinal wall sections 26 (FIG. 1) of the base converge toward a peak 28, and transverse wall sections 30 (FIG. 3) of the base also converge toward that peak 28, with the peak 28 being spaced from the plane of the mounting portion 14.

Figure 2:
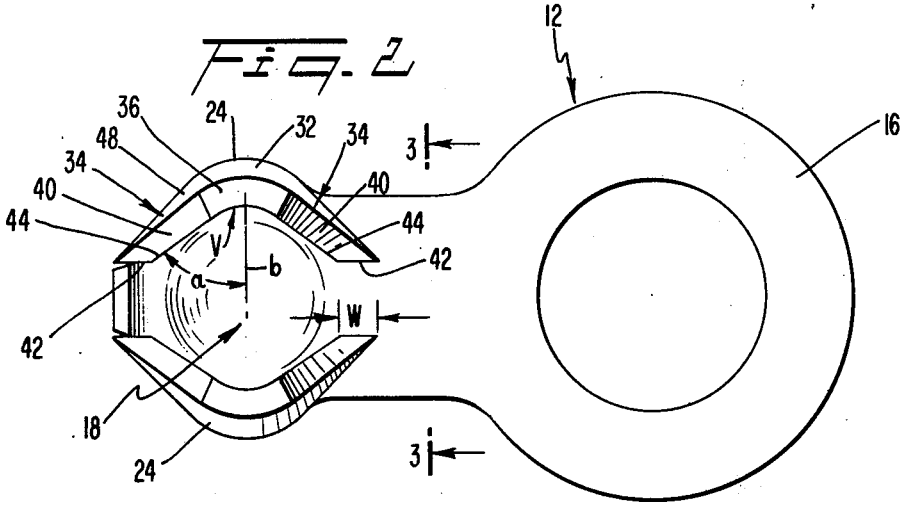
FIG. 2 is a plan view of the terminal wherein the inside of the conductor-receiving socket is viewed.
Figure 3:
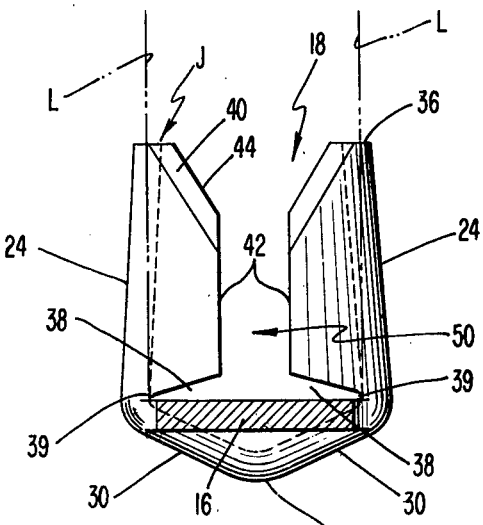
FIG. 3 is a front view of the terminal.
Figure 4:
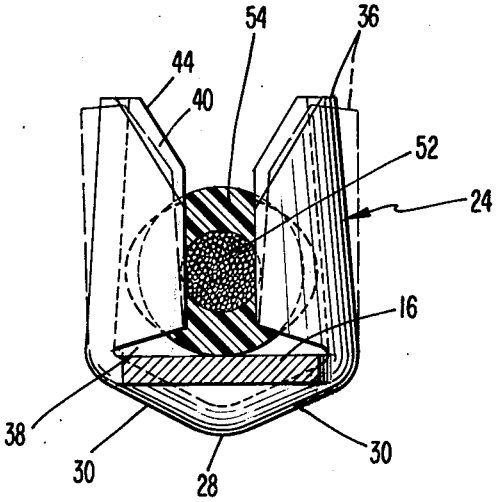
FIG. 4 is a front view of a terminal depicting in solid lines the orientation of the terminal walls prior to termination, and in broken lines the orientation of the walls following termination.

The socket walls 24 extend generally laterally from the longitudinal and transverse wall section 26, 30 of the base, and form, with the base, a generally U-shaped configuration (FIG. 3). Each socket wall 24 is of generally V-shape configuration (FIG. 2), including a bight portion 32 and a pair of arm portions 34. The bight portion 32 forms a vertex portion of the V-shaped arms. The bight portion 32 includes an outer edge surface 36 which is flat and lies in a plane parallel to the axis of the conductor to be clamped.

The arm portions 24 each extend from the bight portion at an acute angle a preferably about 40–60 degrees, most preferably 45 degrees, relative to a plane b bisecting the vertex. The arm portions 34 are spaced from the base to form notches 38 therewith (FIG. 3). The notches 38 are dimensioned and arranged so that the inner ends 39 thereof terminate at a location which generally underlies the junction of the bight portion 32 and a respective arm portion 34.

Figure 7:
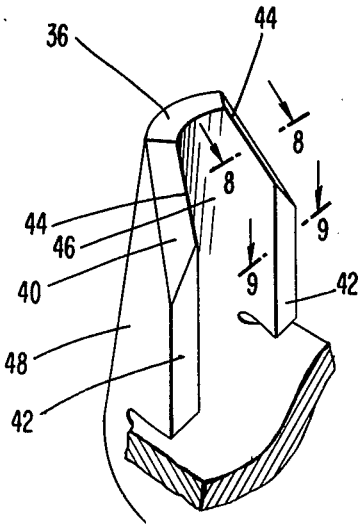
FIG. 7 is an isometric fragmentary view of one wall of the terminal.
Figure 8:
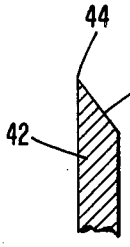
FIG. 8 is a sectional view of the terminal wall taken along line 8—8 in FIG. 7, depicting the inclined nature of the guide surface.

Each arm portion includes a guide surface 40 and a termination surface 42. The guide surface 40 of each arm portion is inclined relative to the plane of the flat surface 36 in a direction toward the base 22 (FIG. 3). The guide surface is sharpened to form a cutting edge 44 which defines an outer end edge of an inside face 46 of the arm portion 34 (FIG. 7). The guide surface 40 is inclined from this sharpened edge 44 toward an exterior face 48 of the arm portion. That is, the guide surface 40 of one arm portion 34 is inclined from its cutting edge 44 in a direction away from the other guide surface of the same wall 24. As will be discussed, this bevelled arrangement enables the guide surface 40 to cam or wedge a severed portion of the insulation laterally outwardly of the terminal.

The termination surfaces 42 of each wall portion 34 lie in a common plane disposed parallel to the longitudinal axis A of the mounting portion 12. Each termination surface extends from an associated notch 38 to an associated guide surface 40. Mutually facing termination surfaces (FIG. 3) are spaced laterally of the axis A to define a slot 50, the width of the slot being less than the diameter of the wire portion 52 of the conductor. The slots 50 together define an axis which is coincident with the axis of the conductor once termination is complete.

The inclined guide surfaces 40 serve to center the conductor above the slots 50. As inward pressure is applied to the conductor, forcing it against the cutting edges 44, the insulation sheath 54 is pierced. As the insulation is cut, portions 56 thereof are cammed or wedged laterally away from the wire portion 52 along the inclined guide surfaces 40. Simultaneously therewith, the wire portion 52 enters the slots 50, causing the socket walls 24 to be spread apart in a direction A (FIG. 6) laterally of the conductor about an axis 60 (FIG. 1) extending through the peak 28 parallel to the axis of the conductor, and causing the arm portions 34 of each wall to be spread apart in a direction B (FIG. 6), which direction B forms an acute angle relative to the conductor axis. Spreading of the arm portions is facilitated by the 40–60 degree angle a which maximizes the moment arm tending to spread the arms in direction B. Spreading is also facilitated by the notches 38 which enable the arm portions to swing about an axis L disposed parallel to the slot. As the wire portion 52 enters the slots 50, it is engaged by the flat termination surfaces 42. Once the insulation has been fully severed and the wire portion has entered the slots, the wire portion 52 is firmly gripped by the clamping portion 12. That is, the socket walls 24 react against the wire portion by means of laterally inwardly imposed forces (i.e., opposite to direction A). At the same time, the arm portions react against the wire portion by means of forces having lateral and longitudinal directional components (i.e., opposite to direction B).

These reactant forces are applied against the wire portion along the entire width W of the termination surfaces. This is significant since it compresses rather than cuts the wire strands and maximizes the conductive contact between the terminal and the wire. Minimum cold flow of the wires occurs while contact is maintained. Also important is the function performed by the guide surface 40 in camming the severed insulation portion 56 outwardly of the arm portions where they do not resist termination efforts and do not interfere with electrical contact between the termination surfaces and the wire portion.

The slots 50 are each configured so as to narrow toward the sharpened edges, i.e., the spacing between the termination surfaces 42 lessens in the direction of the guide surface 40. This orientation tends to compensate for any loss of resiliency of the arm portions as they are spread apart. Once the wire portion is in place in the slots, the termination surfaces assume a generally parallel relationship.

Figure 10:
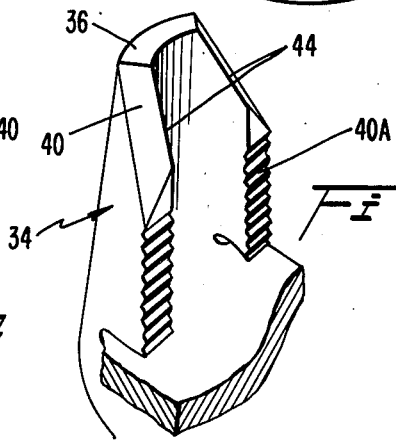
FIG. 10 is an isometric fragmentary view of a terminal wall depicting an alternate form of termination surface.
Figure 9:
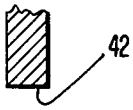
FIG. 9 is a sectional view of the terminal wall taken along line 9—9 in FIG. 7, depicting the shape of one preferred termination surface.

A modified form of the invention is depicted in FIG. 10 wherein termination surfaces 40A are of a serrated nature. These serrations are effective in scraping-off varnish coatings which are applied to some conductors. The advantages of the flat termination surface 40 described earlier are still present, including a gripping action against the wire portion which occurs across the entire width of the termination surface 40A.

In operation, a conductor 20 is terminated by being pressed into the slots 50. In so doing, the cutting edges 44 pierce the insulation and the guide surfaces 40 cam the cut insulation portions 56 outwardly of the arm portions 34 where they cannot interfere with termination. As the wire portion 52 enters the slots 50 it flexes the walls 24 apart in direction A and spreads the arm portions 34 apart in direction B. Subsequently, the wall and arm portions, by residual spring action in directions A and B, impose clamping forces on the wire portion which are directed in lateral and longitudinal directions. The clamping forces applied by the termination surfaces 42 extend across the entire width W of such surfaces.

It will thus be appreciated that by virtue of the present invention the wire portion is gripped by termination surfaces, under the influence of forces generated by the separate spring actions of the walls 24 and the arm portions 34. Spreading of the arm portions is facilitated by the relatively large angle a and by the extended notches 38. The cutting edges 44 sever the insulation before contact occurs between the wire portion and the termination surface. No cutting or nicking of the wire portion occurs as it travels within the slot. Rather, the termination surfaces 42 engage and compress the conductor and make contact therewith along essentially the entire width of the termination surfaces. Thus, the bundle of wire strands is compressed and minimum cold flow of the wires occurs. The insulation is wedged away from the cut termination surface so as to avoid any interference thereof with electrical engagement between the surface and the conductor. The initial non-parallel relationship between the termination surfaces of each slot compensates for any loss in resiliency when the walls are flexed outwardly.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. An electrical terminal of the type including a mounting portion and an integral conductor clamping portion which strips and captures an insulated conductor, said clamping portion including:

a base;

a pair of walls projecting from said base, each wall including a pair of arm portions, the arm portions of one wall being spaced oppositely from corresponding arm portions of the other wall to form a pair of longitudinally spaced slots, each arm portion extending at an acute angle relative to a plane bisecting a vertex joining said arm portions and comprising:

a guide surface inclined toward its associated slot such that the opposing arm portions of each wall orient a conductor above the slots, each guide surface including an inner edge which is sharpened to define a cutting edge for piercing an insulation cover of the conductor as the conductor is pushed into the slots, and each guide surface being bevelled from said cutting edge in a direction generally away from the other guide surface of the same wall so that as the insulation cover is pierced, it is wedged outwardly of the terminal, and a termination surface extending from said guide surface toward said base and forming the sides of said slots; each termination surface being oriented such that conductive engagement between said termination surface and the wire portion of said conductor extends along the entire width of said termination surface.

2. A terminal according to claim 1, wherein said base is generally concave as viewed from inside the clamping portion, said base comprising convergent longitudinal wall sections and convergent transverse wall sections, said wall sections converging to form a peak generally centrally of said base.

3. A terminal according to claim 1, wherein each arm portion is spaced from said base to form a notch, the closed end of said notch generally underlying the transverse outer end of said guide surface.

4. A terminal according to claim 1, wherein said acute angle is about 40 to 60 degrees.

5. A terminal according to claim 1, wherein said termination surface is flat.

6. A terminal according to claim 1, wherein said termination surface is of serrated configuration.

7. A terminal according to claim 1, wherein said mounting portion extends from said base in a direction generally parallel to said longitudinal axis.

8. A terminal according to claim 1, wherein said termination surfaces of each slot are convergent toward the open end of said slot prior to insertion of the conductor and are essentially parallel thereafter.

9. An electrical terminal of the type including a mounting portion and an integral conductor clamping portion which strips and captures an insulated conductor, said clamping portion including:

a base comprising convergent longitudinal wall sections and convergent transverse wall sections, said longitudinal and transverse wall sections converging to form a peak generally centrally of said base, a pair of walls projecting from said longitudinal wall sections of said base, each wall including a pair of arm portions separated by a bight portion, said bight portion being generally V-shaped and forming a vertex, each arm portion forming an angle of about 40 to 60 degrees with a plane bisecting said vertex, the arm portions of one wall being spaced oppositely from corresponding arm portions of the other wall to form a pair of longitudinally spaced slots, each arm portion comprising:

a guide surface inclined toward its associated slot such that the opposing arm portions of each wall orient a conductor above the slots, each guide surface including an inner edge which is sharpened to define a cutting edge for piercing an insulation cover of the conductor as the conductor is pushed into the slots, and each guide surface being bevelled from said cutting edge in a direction generally away from the other guide surface of the same wall so that as the insulation cover is pierced, it is wedged outwardly of the terminal, and a termination surface extending parallel to the vertex of said bight portion from said surface toward said base and forming the sides of said slots, each termination surface being oriented such that conductive engagement between said termination surface and the wire portion of said conductor extends along the entire width of said termination surface, the arrangement being such that upon insertion of a conductor into said slots, said walls are urged transversely outwardly about said peak as an axis and said arm portions are urged outwardly about the vertex of said bight portion as an axis in a direction forming an acute angle relative to said longitudinal axis.

10. A terminal according to claim 9, wherein said termination surface is of serrated configuration.

11. A terminal according to claim 9, wherein said termination surface is flat.

12. A terminal according to claim 9, wherein said mounting portion extends from said base in a direction generally parallel to said longitudinal axis.

13. A terminal according to claim 9, wherein each arm portion is spaced from said base to form a notch, the closed end of said notch generally underlying the transverse outer end of said guide surface.

14. A terminal according to claim 9, wherein said termination surfaces of each slot are convergent toward the open end of said slot prior to insertion of the conductor and are essentially parallel thereafter.

* * * * *